US006938533B2

(12) United States Patent
Holland et al.

(10) Patent No.: US 6,938,533 B2
(45) Date of Patent: Sep. 6, 2005

(54) BLAST ATTENUATION CONTAINER

(75) Inventors: Steven Holland, Long Gaton (GB); David Christian, Allestree (GB)

(73) Assignee: Aigis Engineering Solutions, Ltd., Derby (GB)

( * ) Notice: Subject to any disclaimer, the term of this patent is extended or adjusted under 35 U.S.C. 154(b) by 0 days.

(21) Appl. No.: 10/467,547

(22) PCT Filed: Feb. 8, 2002

(86) PCT No.: PCT/GB02/00541

§ 371 (c)(1),
(2), (4) Date: Jan. 26, 2004

(87) PCT Pub. No.: WO02/065050

PCT Pub. Date: Aug. 22, 2002

(65) Prior Publication Data

US 2004/0134335 A1 Jul. 15, 2004

(30) Foreign Application Priority Data

Feb. 9, 2001 (GB) ..... 0103300

(51) Int. Cl.[7] ..... F42B 33/00
(52) U.S. Cl. ..... 86/50
(58) Field of Search ..... 86/50

(56) References Cited

U.S. PATENT DOCUMENTS 3,096,900 A * 7/1963 Breneman ..... 220/4.26
3,306,486 A * 2/1967 Martino et al. ..... 220/254.3
3,394,832 A * 7/1968 McAllister et al. ..... 220/254.3
3,720,844 A * 3/1973 Sahs ..... 307/112
3,796,267 A * 3/1974 Hunter et al. ..... 169/57
3,800,715 A * 4/1974 Boller ..... 109/49.5
D270,677 S * 9/1983 Creske ..... D34/8
4,437,382 A * 3/1984 Yerushalmi ..... 86/50
4,543,872 A * 10/1985 Graham et al. ..... 86/50
4,554,868 A * 11/1985 Zimmer ..... 100/229 R
4,925,044 A * 5/1990 Hembert ..... 220/589
5,864,767 A * 1/1999 Drumgoole et al. ..... 588/202
6,112,931 A * 9/2000 Booth et al. ..... 220/88.1

FOREIGN PATENT DOCUMENTS

EP 0315616 A1 * 5/1989 ..... F42D/5/04
EP 0440889 A1 * 8/1991 ..... B65F/1/08
FR 2765198 12/1998
GB 2276530 10/1994
GB 2278045 11/1994
GB 2279232 A * 1/1995 ..... F41H/5/04

* cited by examiner

*Primary Examiner*—Teri Pham Luu
*Assistant Examiner*—Bret Hayes
(74) *Attorney, Agent, or Firm*—James W. Kayden; Thomas, Kayden, Horstemayer & Risley, LLP

(57) ABSTRACT

A blast attenuation container, such as a litter bin or a container for storing explosive devices, is provided. The container includes an outer cover (22) defining an internal cavity and an inner receptacle (2) for containing litter or explosive devices. The gaining access to the internal cavity. The inner receptacle is lined with or formed from blast attenuation material for minimising the effects of a blast from an explosive device placed therein.

22 Claims, 6 Drawing Sheets

BLAST ATTENUATION CONTAINER

The present invention relates to a blast attenuation container for minimising the effects of an explosive device being detonated inside the container.

Although the following description refers almost exclusively to litter bins, it will be appreciated by persons skilled in the art that the present invention can relate to any container for minimising the effects of an explosive device, being detonated inside the container. For example, the container can be a post box or a container for explosives or pyrotechnics.

Litter bins are often targeted by terrorists for the location of explosive devices since the devices can be easily deposited and are hidden from view from security staff who are continually on the look out for suspect packages. Once warning of a bomb threat has been delivered, the bomb threat area has to be evacuated and checked for suspect packages. Litterbins are notoriously difficult to inspect since any disturbance of the litter could potentially result in detonation of an explosive device. This problem prolongs the inspection of the area and results in great inconvenience to the people evacuated from the area. It also increases the danger of the experts drafted in to find and deactivate any explosive devices.

Unfortunately explosions have been detonated in litterbins and have resulted in fatalities and serious injury to the public. Some conventional litter bins have been designed to reduce the force of a blast by incorporating hoop type formations of reinforced material around the perimeter of the same. A problem encountered with such litterbins is that whilst the hoops reduce the lateral force of the blast to some degree, they do not reduce the blast sufficiently to prevent injury to people. In addition, such bins will tend to drive the force of the blast in the direction of least resistance, i.e., upwardly. Thus litterbins are not typically designed to reduce the vertical force of a blast. Furthermore, although the force of the blast causes the majority of damage, explosion of the bin itself can result in damage and injury due to lateral and vertical fragmentation; the fragments forming high speed projectiles.

It is therefore an object of the present invention to provide a container which attenuates the force of a blast detonated from inside the same and which overcomes the abovementioned problems.

It is a further object of the present invention to provide a container which is inexpensive to produce, which can withstand the force of a blast and which is aesthetically pleasing to the eye.

According to a first aspect of the present invention there is provided a blast attenuation container, said container including an outer cover defining an internal cavity and an inner receptacle located in said internal cavity, said inner receptacle for containing one or more items, said outer cover having access means for gaining access to the inner receptacle and wherein at least said inner receptacle is lined with or formed from at least one type of blast attenuation material, thereby minimising the effects of a blast from an explosive device placed in said inner receptacle.

Preferably the inner receptacle minimises the lateral effects of the blast.

Preferably the inner receptacle is provided with an extension portion covering the whole or a substantial part of an upper surface or top of the inner receptacle. The extension portion can contact the upper surface directly or be provided a spaced distance apart therefrom.

The extension portion can be provided with liquid suppression means, liquid/air suppression means and/or an expansion chamber means. Any of these means can be used singly or in combination. The liquid acts to absorb the energy of the blast and can include water The water and air ratios can be varied to produce desired levels of protection. The extension portion can also be lined with or formed from blast attenuation material.

Preferably the liquid in the extension portion is treated against fungal and bacterial growth by using a fungicide, bactericide, sterilising solution/composition and/or the like.

Further preferably the liquid in the extension portion is treated against freezing by using an anti-freeze.

The extension portion can be supported above the inner receptacle one or more supporting legs or by any other conventional supporting means. For example, the extension portion can be supported by attachment means between the inner receptacle and/or the outer cover.

The extension portion or top of the blast attenuation container according to the present invention can be retrofitted to a conventional container or litter bin.

Since the corners and edges of an object are susceptible to the concentration of stress and crack initiation, these areas are most affected by the force of a blast. It is therefore preferable to minimise the number of edges and corners of the inner receptacle and outer cover, for example a substantially cylindrical receptacle and outer cover can be used.

Preferably the expansion chamber is spherical or oval in shape. Alternatively the expansion chamber can be substantially cylindrical in shape.

The inner receptacle can be made from over wrapped glass woven rovings in a matrix of resin, such as epoxy resin. Alternatively, the glass woven rovings are formed by proper filament winding, which creates greater hoop strength for the same weight of material used.

The blast attenuation material used to line the inner receptacle and/or extension portion/top is preferably resin particulate material. This material is typically porous. The outer cover can also be lined with a blast attenuation material if required or it can simply be an aesthetic cover.

Preferably the outer cover is cylindrical and has a dome shaped top portion to prevent items from being placed on top of the same. The top portion can have one or more access ports for the posting of items into the inner receptacle. The top portion is dome shaped and the access ports are preferably cylindrical to minimise the number of edges and corners which can undergo damage following a blast.

Preferably the outer cover is lightweight and frangible.

Preferably the outer cover has one or more advertising spaces provided thereon.

The top portion can be integrally formed with the outer cover or it can be non-integral and detachably attached using fastening or locking means.

Further preferably one or more access ports having internally fitted closure flaps are provided in the Outer cover, top portion and/or inner receptacle. The closure flaps can be the same size as the access ports but preferably the flaps are oversized compared to the size of the access ports they are protecting. The flaps can be attached by any conventional attachment means such as hinges or a sliding mechanism.

In one embodiment the outer cover helps to minimise the effect of a blast, in addition to, or as an alternative to the inner receptacle. For example, the outer cover can be lined with blast attenuation material Preferably the blast attenuation container is provided with movement means for moving the inner receptacle into and out of the internal cavity defined by the outer cover via the access means. The movement means allows lateral movement of the inner receptacle from the outer cover, thereby minimising the movement and disturbance to the contents of the inner receptacle compared to lifting the inner receptacle vertically from the outer cover.

The movement means also has the advantage of allowing the contents of the inner receptable to be removed and or items to be located therein, remotely without direct contact with the receptacle or with reduced physical contact with the receptacle. Control means can be provided to operate the receptacle remotely.

Preferably the movement means includes a roller or slide assembly for providing the lateral movement. The assembly comprises frame means of sufficient strength to support the weight of the inner receptacle, empty or full, and to withstand frequent use. The inner receptacle is slidably located in or on the frame means.

The frame means are mounted on a supporting plinth or base of the container. The supporting plinth can be made from bomb attenuation material such that in the event of an explosion, the downward dynamic loading caused by the blast is mostly taken up by the bomb attenuation material. This has the effect of reducing the amount of energy transmitted to the ground and thereby minimising the effects of the blast.

Preferably the access means via which the inner receptacle is removed from the outer cover is separate from the one or more other access ports for locating items in the inner receptacle.

Further preferably the access means for the inner receptacle removable is located on a sidewall of the outer cover.

Additional security features can be used on the container. For example, locking devices could be used on one or all of the access ports.

The container can be a litter bin, post box, explosives or pyrotechnic container and/or the like.

Embodiments of the present invention will now be described with reference to the accompanying figures wherein.

Figure 5A:
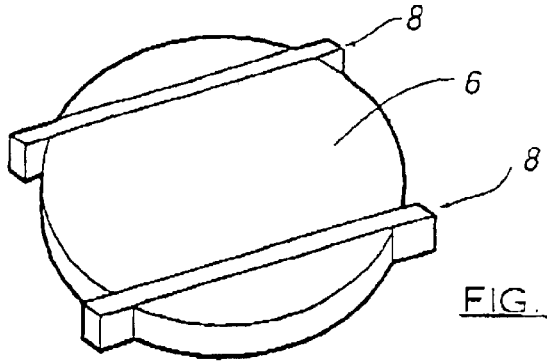
Figure 5B:
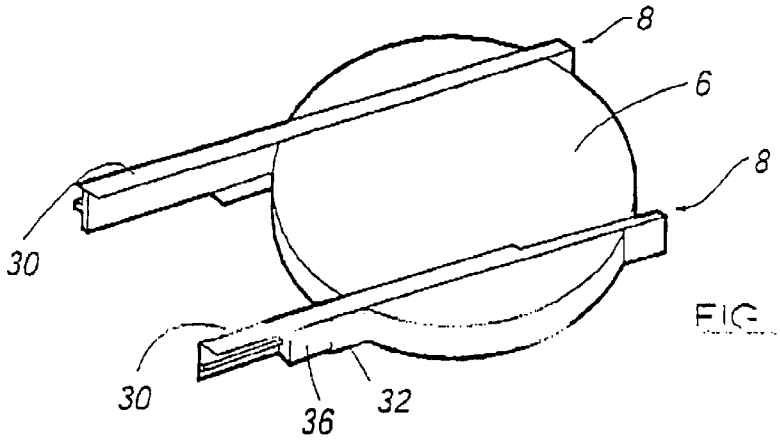
Figure 5C:
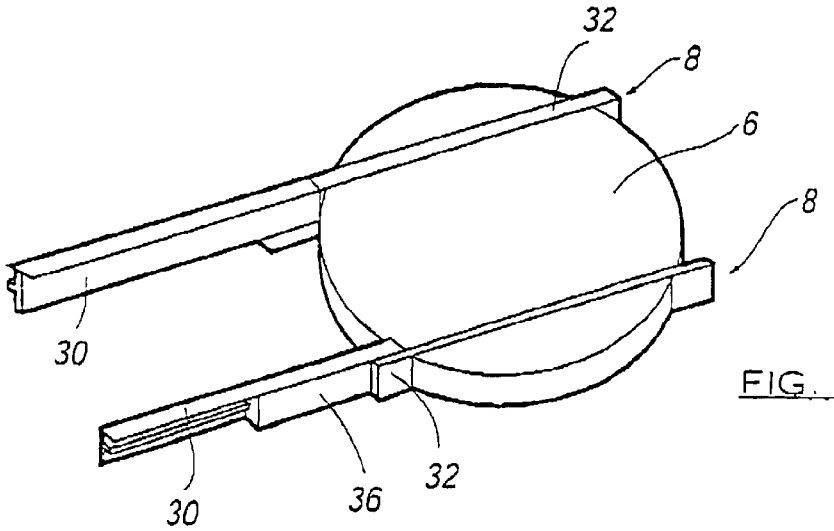
Figure 6:
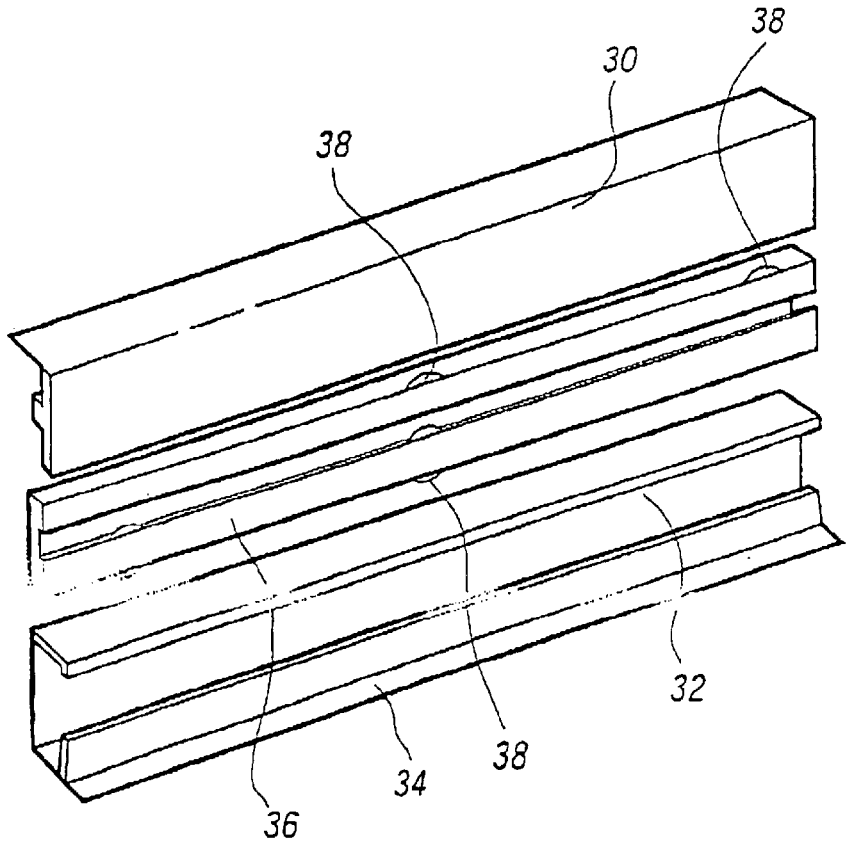
Figure 7A:
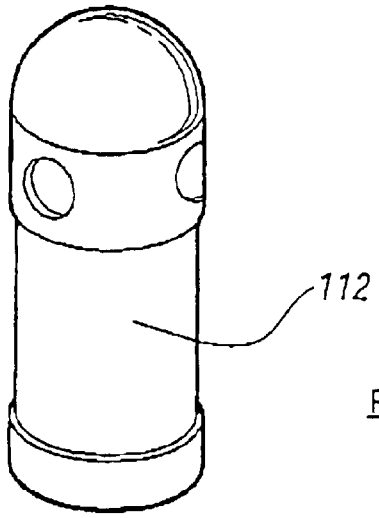
Figure 7B:
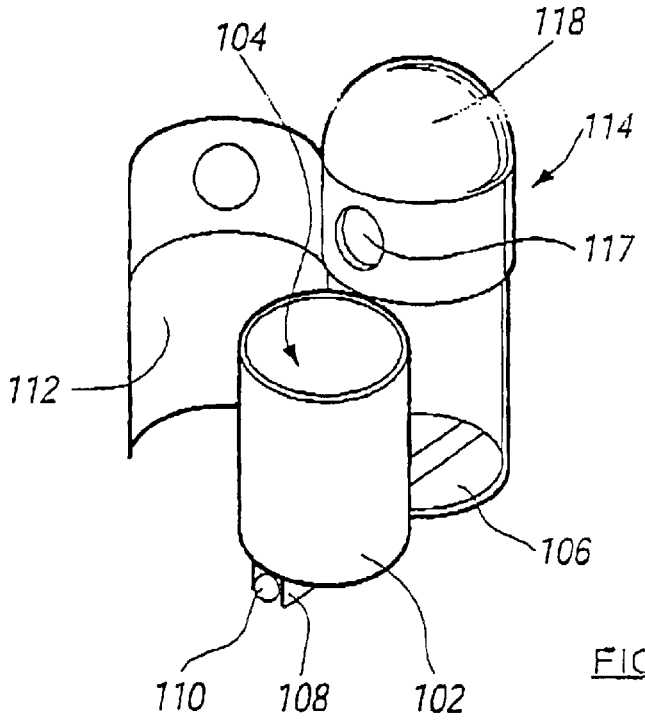
Figure 7C:
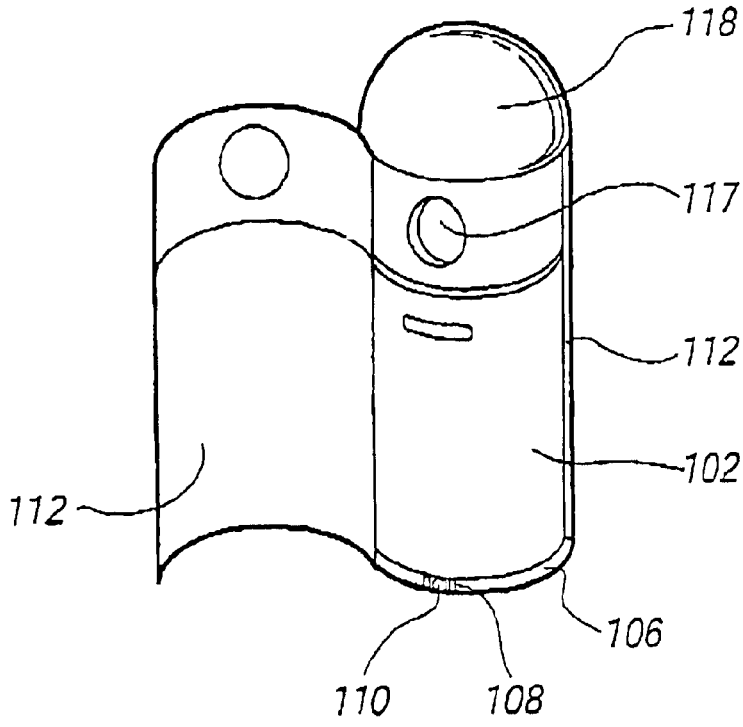

FIG. 5*a* is a perspective view of a portion of the inner receptacle movement means when in a closed position;

FIG. 5*b* is a perspective view of a portion of the inner receptacle movement means when in a partially open position;

FIG. 5*c* is a perspective view of a portion of the inner receptacle movement means when in a fully open position;

FIG. 6 is an exploded view of a roller/slider assembly for use with the inner receptacle movement means according to the present invention;

FIG. 7*a* is a perspective view of a litterbin according to a further embodiment of the present invention;

FIG. 7*b* is a perspective view of the litterbin in FIG. 7*a* when the inner receptacle is in an open position;

FIG. 7*c* is a perspective view of the litterbin of FIG. 7*a* with the inner receptacle in a closed position.

Figure 1:
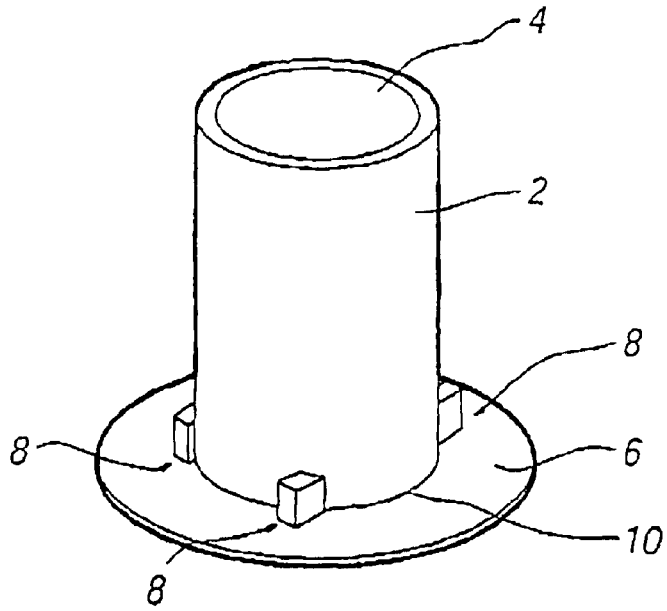
FIG. 1 is a perspective view of an inner receptacle of a blast attenuation litterbin according to an embodiment of the present invention.

Referring firstly to FIG. 1, there is illustrated an inner receptacle or tub 2 for the containment of litter. The inner rub is lined with blast attenuation material 4 and is located on a support plinth 6 which also comprises blast attenuation material. Movement means in the form of a roller/slider mechanism 8, which forms part of an inner rub extraction device, is mechanically attached to a base 10 of the tub 2. The roller/slider mechanism 8 is also mounted on support plinth 6.

Figure 2:
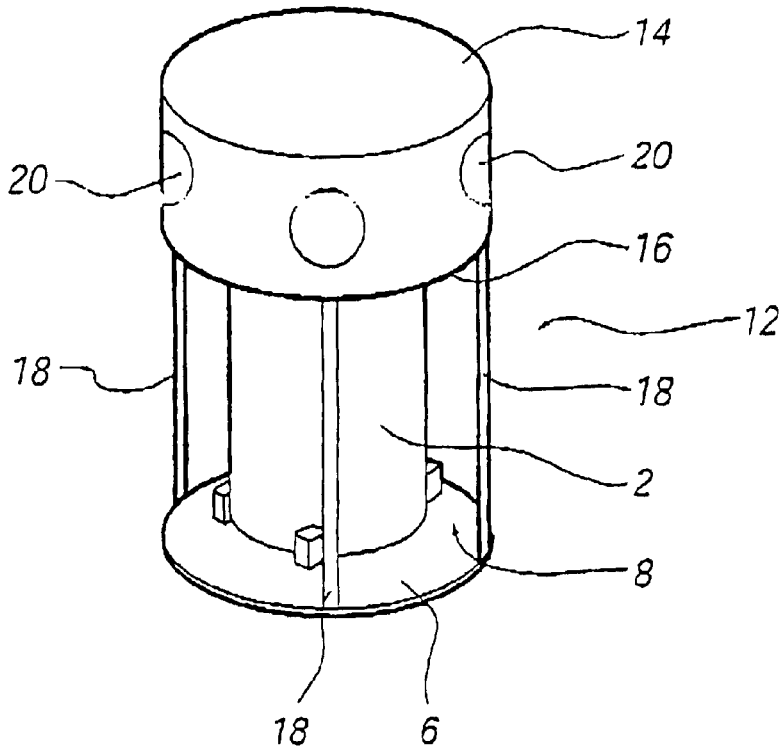
FIG. 2 is a perspective view of an inner receptacle with an extension portion according to an embodiment of the present invention.

An extension portion 12 is provided which has a top section 14 covering the top 16 of the inner tub 2, as illustrated in FIG. 2. The extension portion 12 has a plurality of supporting legs 18, which are spaced a sufficient distance apart to allow the inner tub 2 to be moved between the same.

The extension portion 12 is also provided with a number of access ports 20 through which litter can be posted such that it falls into the inner tub 2. The access ports 20 are provided with oversized flaps (not shown), which are mounted on the inside of the extension portion 12, thereby preventing the flaps and/or contents of the tub from being forced out of the access ports in the event of a blast.

The extension portion can be provided with water suppression means, water/air suppression means and/or an expansion chamber. The water and air ratios can also be varied to produce desired levels of protection. The water can be replaced by another liquid if desired. The water or other liquid attenuates the force/energy of a blast.

Figure 3:
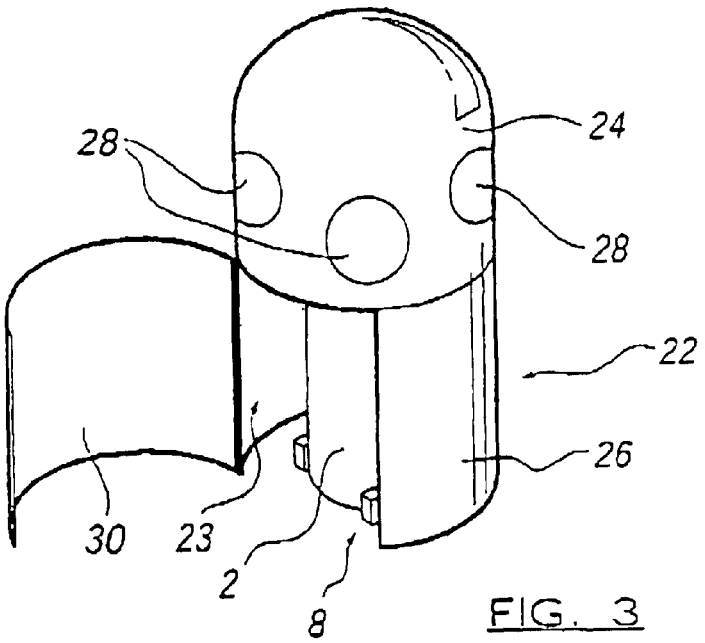
FIG. 3 is a perspective view of a blast attenuation litterbin according to an embodiment of the present invention.

Referring to FIG. 3, there is illustrated an outer cover 22 for a litterbin which defines an internal cavity 23 in which the inner tub 2 and extension portion 12 are located.

The outer cover 22 comprises a dome shaped top portion 24 and cylindrical sidewalls 26. The dome portion 24 has access ports 28, which correspond to the size and position of the access ports 20 in the extension portion 12, for the posting of litter into the inner tub 2. Access ports 28 can be provided with oversized flaps (not shown) in a similar manner to the access ports 20. The flaps can be attached by a conventional hinge or sliding mechanism and are a close fit with the access ports in order to prevent blast emission through the same. The flaps can also comprise security devices by which they can be locked to prevent unwanted packages being placed through them if the bins are in a high risk bomb threat area.

Figure 4:
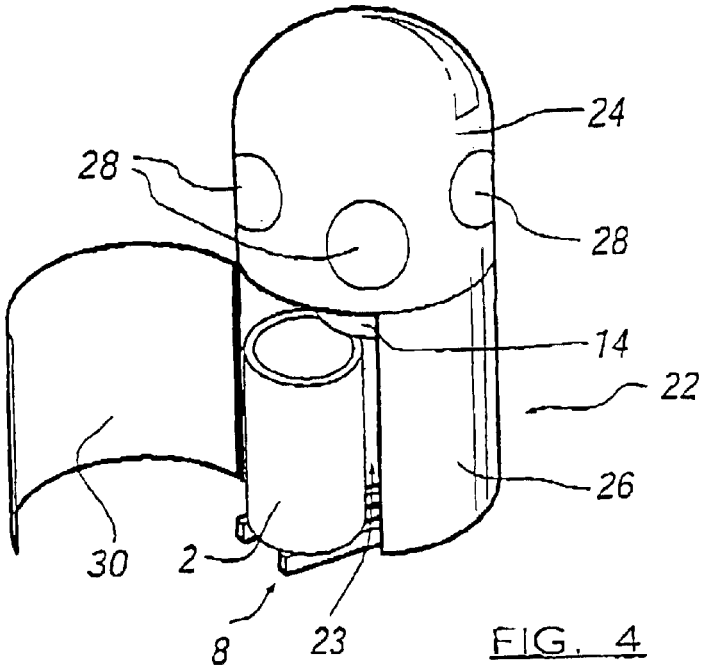
FIG. 4 is a perspective view of the blast attenuation litterbin illustrating the movement means of the bin.

A further access port 30 is provided in sidewall 26 to allow the inner tub 2 to be extracted from the outer cover via sliding of the same along the roller/slider mechanism 8, as illustrated in FIG. 4. The inner tub can then be emptied and bin liners can be fitted or removed.

The opening of access port 30 and operation of the inner tub extraction device can be performed manually or by automated control means. For example a bomb disposal robot or EOD could be used.

The dome 24 is shaped accordingly to prevent litterbags or packages being placed on top of the outer cover. However, the dome can be reshaped to provide flat sections along the sides to provide advertisement space. The dome can be integral with the sidewalls 26 or it can be non-integral and fastened or locked in position.

Referring to FIGS. 5*a–c* and 6, there is illustrated a roller/sliding mechanism 8 which forms the movement means for extraction of inner tub from the outer cover in a lateral direction. The roller/sliding mechanism 8 comprises a top section 30 which is bolted to the base 10 of the inner tub 2, a bottom section 32 which is bolted into the support plinth 6 via base plate 34 and a central slider unit 36 which has a number of rollers 38 acting as a sliding interface between top section 30 and bottom section 32. It is noted that any other conventional slide/roller mechanism could be used. For example, the inner tub can include rollers on the base thereof slidably located on frame means provided on the support plinth. The frame means can include telescopic arms which allow the tub to be moved from a closed bin position within the outer cover to an open bin position outside the outer cover.

Referring to FIGS. 7*a*–7*c*, there is illustrated a further embodiment of an inner tub 102 for the containment of litter. The inner tub is lined with blast attenuation material 104 and the tub is located on a support plinth 106.

An inverted channel 108 is provided on the base of the inner tub and houses a wheel 110, typically made of rubber. The wheel 110 allows the tub to be moved in and out of an outer cover 112.

An expansion chamber 114 is provided above the inner rub and comprises an access port 116 and a water/liquid chamber 118 above the access port 117 contained within the outer cover 112. The water/liquid chamber 118 contains a plurality of air pockets therein, typically provided by bubble wrap or similar.

The inner tub 102 and expansion chamber 114 can be made from the same moulding and be supported within the outer cover via two rectangular support sections. The support sections provide the points of attachment for the hinges of the outer cover door and door lock.

The bomb attenuation material which lines inner tub 2 is preferably porous, particulate resin material. For example, a material such as TABRE could be used. Lining the cylinder with blast attenuation material has been shown to reduce the force of the blast by 30%. The thickness of the material within the inner tub can be altered according to where the greatest need for absorption of energy created by the blast. For example, the material can be of greater thickness around the floor/sidewall interface. Both the material and inner tub can be X-Ray transparent, thereby allowing the same to be inspected for a suspect device. Inspection can occur both when the inner tub is locked in the outer cover and when it is extended from the outer cover.

The expansion portion or top can be lined with bomb attenuation material and can be used in combination with a conventional bin or with a litterbin according to the present invention.

The components of the litterbin are cylindrical where possible. However, other shaped components can be used.

The outer covers can be coloured and designed in a variety of ways to make them blend in more effectively in a particular environment. The outer cover can also be lined with bomb attenuation material if required but it is preferable for the outer cover to be lightweight and frangible. For example, the outer cover can be made from moulded plastic or lightweight glass Fibre. This means that in the event of a blast there is no high energy jagged fragments projected laterally.

The inner tub can be made from over wrapped or filament wound glass woven rovings in a matrix of resin such as epoxy resin.

The liquid in the expansion portion can be treated with fungicides or the like to prevent bacterial/fungal growth in the same. In addition, the liquid can be treated with antifreeze to prevent the same from freezing.

Thus the present invention provides an improved inexpensive container which is capable of reducing both the lateral and vertical effects of a blast caused by an explosive device location therein.

What is claimed is:

1. A blast attenuation container, said container including an outer cover defining an internal cavity and an inner receptacle located in said internal cavity, said inner receptacle for containing one or more items, said outer cover having access means for gaining access to the inner receptacle, wherein at least said inner receptacle is lined with or formed from blast attenuation material, thereby minimizing the effects of a blast from an explosive device placed in said inner receptacle, wherein the inner receptacle is provided with an extension portion covering the whole or a substantial part of an upper surface or top of the inner receptacle, the extension portion configured to contact the upper surface of the inner receptacle, the extension portion spaced at a pre-determined distance apart from the upper surface of the inner receptacle, wherein the extension portion is supported on or above the upper surface of the inner receptacle by one or more supporting legs, the supporting legs being spaced a sufficient distance apart to allow for movement of the inner receptacle.

2. A blast attenuation container according to claim 1 wherein the extension portion is lined with or formed from blast attention material.

3. A blast attenuation container according to claim 1 wherein the extension portion is provided with any or any combination of liquid suppression means, liquid/air suppression means and/or an expansion chamber.

4. A blast attenuation container according to claim 3 wherein liquid provided in the extension portion contains an antifreeze composition/solution.

5. A blast attenuation container according to claim 3 wherein liquid provided in the extension portion contains any or any combination of a fungicide, a bactericide and/or a sterilizing composition/solution.

6. A blast attenuation container according to claim 1 wherein the extension portion is supported on or above the upper surface of the inner receptacle by attachment means located between the outer cover and the extension portion.

7. A blast attenuation container according to claim 1 wherein movement means are provided for laterally moving the inner receptacle in and/or out of the internal cavity via the access means.

8. A blast attenuation container according to claim 7 wherein the movement means includes a roller/slider assembly.

9. A blast attenuation container according to claim 8 wherein the roller/slidable assembly comprises a frame construction on which the inner receptacle is slidably located.

10. A blast attenuation container according to claim 9 wherein the frame construction includes telescopic arms.

11. A blast attenuation container according to claim 9 wherein the frame construction is mounted on a support base in or forming part of the outer cover.

12. A blast attenuation container according to claim 11 wherein the support base is made from blast attenuation material.

13. A blast attenuation container according to claim 7 wherein control means are provided for operating the movement means remotely.

14. A blast attenuation container according to claim 1 wherein the inner receptacle, extension portion and/or outer cover are substantially cylindrical in shape.

15. A blast attenuation container according to claim 1 wherein the extension portion is substantially spherical or oval in shape.

16. A blast attenuation container according to claim 1 wherein the inner receptacle is formed from over-wrapped or filament wound glass woven rovings in a matrix of resin.

17. A blast attenuation container according to claim 1 the blast attenuation material is a resin bonded particulate material.

18. A blast attenuation container according to claim 1 wherein the outer cover is provided with a top portion which is detachably attached to the outer cover.

19. A blast attenuation container according to claim 18 wherein one or more access ports are provided in the outer cover, extension portion, top portion, and/or inner receptacle for locating one more items in said inner receptacle.

20. A blast attenuation container according to claim 19 wherein closure flaps are provided over said access ports and said closure flaps are attached to an internal surface of the outer cover.

21. A blast attenuation container according to claim 1 wherein the container is any of a litter bin, an explosives or pyrotechnic container or a letter box.

22. A blast attenuation litter bin, said litter bin including an outer cover defining an internal cavity and an inner receptacle located in said internal cavity, said inner receptacle for containing one or more items, said outer cover having access means for accessing the inner receptacle, wherein at least said inner receptacle is lined with or formed from blast attenuation material, thereby minimizing the effects of a blast from an explosive device placed within said inner receptacle, wherein the inner receptacle is provided with an extension portion covering the whole or a substantial part of an upper surface or top of the inner receptacle, the extension portion configured to contact the upper surface of the inner receptacle, the extension portion spaced at a pre-determined distance apart from the upper surface of the inner receptacle, wherein the extension portion is supported on or above the upper surface of the inner receptacle by one or more supporting legs, the supporting legs being spaced a sufficient distance apart to allow for movement of the inner receptacle.

* * * * *